US009400457B1

(12) United States Patent
Honya et al.

(10) Patent No.: US 9,400,457 B1
(45) Date of Patent: Jul. 26, 2016

(54) INTERMEDIATE TRANSFER ELEMENT AND IMAGE FORMATION APPARATUS INCLUDING THE SAME

(71) Applicant: Konica Minolta, Inc., Tokyo (JP)

(72) Inventors: Akihiro Honya, Musashino (JP); Shinichi Hamaguchi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/992,489

(22) Filed: Jan. 11, 2016

(30) Foreign Application Priority Data

Jan. 16, 2015 (JP) ..... 2015-006845

(51) Int. Cl.
*G03G 15/01* (2006.01)
*G03G 15/16* (2006.01)

(52) U.S. Cl.
CPC ..... *G03G 15/162* (2013.01)

(58) Field of Classification Search
CPC ..... G03G 15/162
USPC ..... 399/302
See application file for complete search history.

(56) References Cited

FOREIGN PATENT DOCUMENTS

| | | | |
|---|---|---|---|
| JP | 2001047451 | A | 2/2001 |
| JP | 2007316622 | A | 12/2007 |
| JP | 2013024898 | A | 2/2013 |
| WO | 2007046260 | A1 | 4/2007 |
| WO | 2011096464 | A1 | 8/2011 |

*Primary Examiner* — William J Royer
(74) *Attorney, Agent, or Firm* — Lucas & Mercanti, LLP

(57) ABSTRACT

An intermediate transfer element is included in an image formation apparatus, has a shape like an endless belt, and includes at least a resin base material layer and a surface layer. The surface layer is composed of a cured (meth)acrylic resin, the cured (meth)acrylic resin contains a constitutional unit derived from a polyfunctional (meth)acrylic monomer, the polyfunctional (meth)acrylic monomer contains n alkylene oxide structures and m (meth)acryloyl groups, with relation of $n/m \leq 5$ and $m \geq 3$ (n and m being a positive integer) being satisfied, and the alkylene oxide structure contains an alkylene group having a carbon number not smaller than 2.

6 Claims, 1 Drawing Sheet

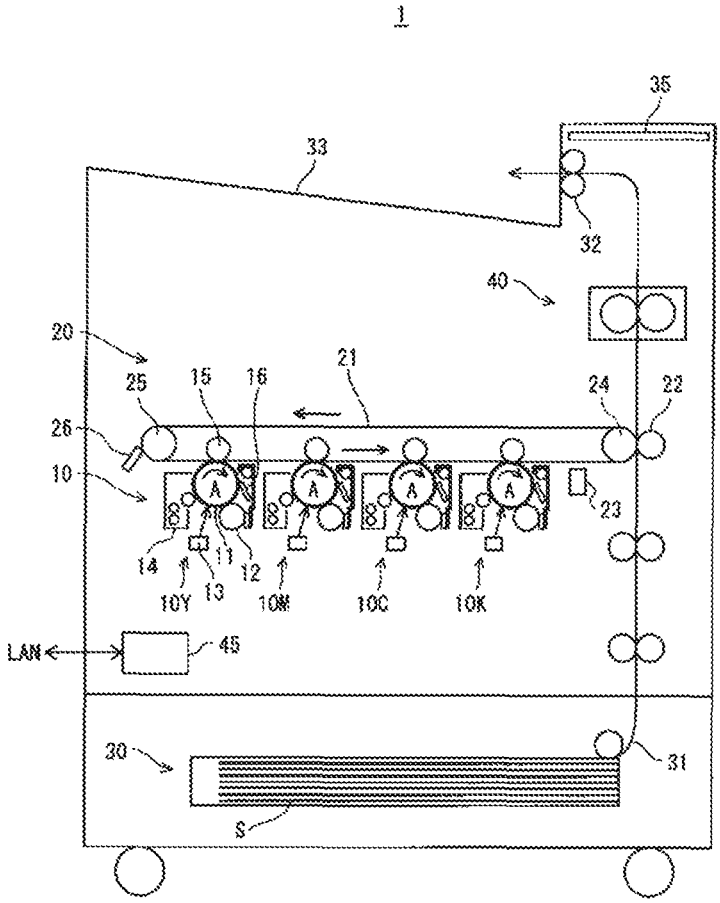
1
35
33
32
40
20
21
25
15
16
24
22
26
10
23
14
11
12
10Y
13
10M
10C
10K
LAN
45
30
31
S

INTERMEDIATE TRANSFER ELEMENT AND IMAGE FORMATION APPARATUS INCLUDING THE SAME

This application is based on Japanese Patent Application No. 2015-006845 filed with the Japan Patent Office on Jan. 16, 2015, the entire content of which is hereby incorporated by reference.

BACKGROUND OF THE INVENTION

1. Field of the Invention

The present invention relates to an intermediate transfer element included in an image formation apparatus and an image formation apparatus including the same.

2. Description of the Related Art

In an image formation apparatus of an electrophotography type, for example, a latent image formed on an electrostatic latent image carrier (also referred to as an image carrier or a photoconductor) is developed with toner, the obtained toner image is temporarily held on an intermediate transfer element (also referred to as an intermediate transfer belt or a transfer member) in a shape of an endless belt, and the toner image on this intermediate transfer element is transferred onto a recording material such as paper.

For example, a polyimide resin has been adopted for such an intermediate transfer element in order to improve a transfer function such as adaptability to paper or image quality (Japanese Laid-Open Patent Publication No. 2001-047451). A temperature of the polyimide resin, however, should be raised to 400° C. or higher for molding, which leads to poor productivity and higher cost.

In an attempt to solve this problem, it has been proposed to adopt a thermoplastic resin for a resin base material layer and to form an inorganic layer on a surface thereof (WO2007/046260A1). Though a rate of transfer is enhanced by forming the inorganic layer having a high hardness, a thickness thereof is small and hence damages are likely when a foreign matter is bitten or a pressure is locally applied.

In another attempt, it has been proposed to form a surface layer composed of a curable resin on a resin base material layer made of a thermoplastic resin (Japanese Laid-Open Patent Publication No. 2007-316622, WO2011/096464A1, and Japanese Laid-Open Patent Publication No. 2013-024898).

SUMMARY OF THE INVENTION

While Japanese Laid-Open Patent Publication No. 2007-316622, WO2011/096464 A1, and Japanese Laid-Open Patent Publication No. 2013-024898 describe use of a polyfunctional monomer for a surface layer, an intermediate transfer element is required to be high in durability. When an amount of blended polyfunctional monomer is increased in order to obtain a high hardness for meeting such a requirement, a resistance value varies due to printing and image quality becomes poor.

The present invention was made in view of such circumstances, and an object thereof is to provide an intermediate transfer element having high durability while having an excellent transfer function by providing a surface layer achieving both of a high hardness and reduction in variation in resistance value, and an image formation apparatus including the same.

The present inventor conducted dedicated studies for solving the problems above, and found that wear and tear can be suppressed by using a cured product of a monomer low in equivalent weight of a functional group such as dipentaerythritol hexa acrylate (DPHA) for a surface layer, whereas many unreached functional groups remain and those unreacted residues tend to deteriorate, which results in tendency of variation in resistance value.

As a result of further studies, it has also been found that a hardness of the surface layer lowers and resultant deterioration in image quality is caused when a bifunctional monomer or a monofunctional monomer is added to reduce unreacted residues.

The present invention was made by further conducting studies based on these findings. It has been found that a surface layer which is high in hardness and allows reduction in variation in resistance value can be obtained by containing a polyfunctional monomer having a specific proportion of alkylene oxide structure in the surface layer of an intermediate transfer element. As a result of further studies, the present invention was completed. Thus, the present invention can provide an intermediate transfer element having high durability while having an excellent transfer function.

Namely, an intermediate transfer element according to the present invention is included in an image formation apparatus in which a toner image carried on an electrostatic latent image carrier is primarily transferred to the intermediate transfer element and thereafter the toner image is secondarily transferred from the intermediate transfer element to a recording material, has a shape like an endless belt, and includes at least a resin base material layer and a surface layer. The surface layer is composed of a cured (meth)acrylic resin, the cured (meth)acrylic resin contains a constitutional unit derived from a polyfunctional (meth)acrylic monomer, the polyfunctional (meth)acrylic monomer contains n alkylene oxide structures and m (meth)acryloyl groups, with relation of $n/m \leq 5$ and $m \geq 3$ being satisfied (n and m being a positive integer), and the alkylene oxide structure contains an alkylene group having a carbon number not smaller than 2.

Here, the polyfunctional (meth)acrylic monomer preferably satisfies relation of $n/m \leq 3$ and $m \geq 3$ (n and m being a positive integer), and the alkylene oxide structure preferably contains an alkylene group having a carbon number from 2 to 5.

The surface layer preferably contains metal oxide fine particles subjected to surface treatment, and the metal oxide fine particles are preferably subjected to surface treatment with a compound having a (meth)acryloyl group.

The present invention also relates to an image formation apparatus including the intermediate transfer element described in any paragraph above.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic diagram showing one example of an image formation apparatus according to the present invention.

DESCRIPTION OF THE PREFERRED EMBODIMENTS

An embodiment of the present invention will be described hereinafter in further detail. When description is given in the embodiment below with reference to a drawing, the same or corresponding elements have the same reference characters allotted.

<Intermediate Transfer Element>

An intermediate transfer element in the present embodiment is included in an image formation apparatus in which a toner image carried on an electrostatic latent image carrier is primarily transferred to the intermediate transfer element and thereafter the toner image is secondarily transferred from the intermediate transfer element to a recording material. Details of such an image formation apparatus will be described later.

Such an intermediate transfer element has a shape like an endless belt and includes at least a resin base material layer and a surface layer. Here, the shape like an endless belt literally means such a shape, and for example, conceptually (geometrically) means such a loop shape as being formed by connecting opposing end portions of one elongated sheet-shaped object. Actually, however, a shape like a seamless belt or a cylinder is preferred.

Such an intermediate transfer element can include any other component so long as it includes at least a resin base material layer and a surface layer. Examples of such other components can include an elastic body layer which will be described later as well as an adhesive layer, a reinforcement layer, and an intermediate layer.

Such an intermediate transfer element preferably ensures electrical and physical performance and has high durability as a result of synergistic actions of the resin base material layer and the surface layer. With the components as above, such an intermediate transfer element achieves an effect of relatively inexpensive manufacturing.

Each component forming the intermediate transfer element will be described below.

<Resin Base Material Layer>

For the resin base material layer included in the intermediate transfer element in the present embodiment, a conventionally known substance used in an application of this type can be employed without being particularly limited. For example, such a resin base material layer can be composed of a resin material such as polycarbonate, polyphenylene sulfide, polyvinylidene fluoride, polyimide, polyamide imide, polyalkylene terephthalate (polyethylene terephthalate or polybutylene terephthalate), polyether, polyether ketone, polyether ether ketone, an ethylene tetrafluoroethylene copolymer, or polyamide. Among these, at least one selected from polyimide, polycarbonate, polyphenylene sulfide, and polyalkylene terephthalate is preferred.

Such a resin base material layer preferably has a Young's modulus exceeding 5.0 GPa, which is measured with a nanoindentation method, and has a thickness preferably from 50 to 200 μm.

Such a resin base material layer can also contain a material which is a blend of a resin material above and an elastic material below. Examples of the elastic material include polyurethane, chlorinated polyisoprene, NBR, chloroprene rubber, EPDM, hydrogenated polybutadiene, butyl rubber, and silicone rubber. One of them alone may be used or two or more of them may be used together.

The resin base material layer preferably contains in particular polyphenylene sulfide or polyimide. Polyimide is formed by heating polyamic acid which is a precursor of polyimide. Polyamic acid is obtained by dissolving a substantially equimolar mixture of tetracarboxylic dianhydride or a derivative thereof and diamine in an organic polar solvent and having them react in a solution state.

When a polyimide-based resin is contained in the resin base material layer, a content of the polyimide-based resin in the resin base material layer is preferably not lower than 51%.

Such a resin base material layer is preferably implemented as a seamless belt or a drum, of which electric resistance value (a volume resistivity) has been adjusted to $10^5$ Ω·cm to $10^{11}$ Ω·cm by adding a conductive substance to a resin material.

Carbon black can be employed as such a conductive substance. Neutral or acid carbon black can be employed as carbon black. Though an amount of conductive substance used is different depending on a type thereof, the conductive substance should only be added such that a volume resistance value and a surface resistance value of the intermediate transfer element are within a prescribed range. Normally, the amount is from 10 parts by volume to 20 parts by volume and preferably from 10 parts by volume to 16 parts by volume with respect to 100 parts by volume of a resin material.

In order to achieve good dispersibility of such a conductive substance in a resin material, a dispersant can also be added. A nylon compound represents an example of such a dispersant.

The resin base material layer can be fabricated with a conventionally known general method. For example, an annular resin base material layer in a shape like an endless belt can be fabricated by melting a resin representing a material in an extruder, molding the resin in a cylindrical shape with an inflation method with the use of an annular die, and slicing the molded product.

<Elastic Body Layer>

In the intermediate transfer element in the present embodiment, an elastic body layer can be formed on the resin base material layer. In this case, the surface layer is formed on the elastic body layer. Therefore, a case that the surface layer is formed on the resin base material layer in the present embodiment is not limited to a case that the surface layer is formed on the resin base material layer as being in direct contact therewith, but for example, a case that the surface layer is formed on another layer such as an elastic body layer formed on the resin base material layer is also included.

Such an elastic body layer is provided as necessary and formed from an elastic body. Examples of the elastic body include rubber, elastomer, and a resin. In particular, from a point of view of durability, chloroprene rubber is preferably included.

Such an elastic body layer has a thickness preferably from 100 to 500 μm in consideration of mechanical strength, image quality, and manufacturing cost.

<Surface Layer>

The surface layer included in the intermediate transfer element in the present embodiment is formed on the resin base material layer (or on another layer when another layer such as an elastic body layer is formed on the resin base material layer, to be read similarly hereafter accordingly as appropriate when such another layer is formed), and preferably formed to cover the entire surface of the resin base material layer. In this case, the surface of the resin base material layer means a surface on a side where a toner image is to be transferred (formed). Even a case that a surface layer is formed on a surface on a side where a toner image is not transferred (formed) (that is, a back surface) or a case that a part of the surface of the resin base material layer is not covered with the surface layer, however, does not depart from the present embodiment so long as the effect as described previously is exhibited.

Such a surface layer is composed of a cured (meth)acrylic resin, the cured (meth)acrylic resin contains a constitutional unit derived from a polyfunctional (meth)acrylic monomer, the polyfunctional (meth)acrylic monomer contains n alkylene oxide structures and m (meth)acryloyl groups, with relation of n/m≤5 and m≥3 being satisfied (n and m being a positive integer), and the alkylene oxide structure contains an alkylene group having a carbon number not smaller than 2. As the cured (meth)acrylic resin includes such a feature, a function as follows is estimated to be exhibited.

Namely, the polyfunctional (meth)acrylic monomer with the specific structure as above which forms a constitutional unit contained in the cured (meth)acrylic resin is estimated to be able to reduce unreacted (meth)acryloyl groups (which will hereinafter also simply be denoted as "(meth)acryloyl residues") and form a dense cross-linked structure as a result of facilitated movement of the (meth)acryloyl group owing to the presence of the alkylene oxide structure (that is, increase in possibility of contact with another reactive group ((meth) acryloyl group), which leads to efficient progress of curing (cross-linking) reaction). Thus, suppression of trapped charges owing to reduction in (meth)acryloyl residues, suppression of chemical change (deterioration) of the (meth) acryloyl residues due to a product from discharging or water vapor and the like, and reduction in damages or wear and tear can be achieved, and hence an excellent transfer function (stability in resistance) and high durability (wear resistance) can be realized.

Namely, the excellent effect as above is exhibited only when the polyfunctional (meth)acrylic monomer contains n alkylene oxide structures and m (meth)acryloyl groups, with relation of n/m≤5 and m≥3 being satisfied (n and m being a positive integer), and the alkylene oxide structure contains an alkylene group having a carbon number not smaller than 2, and unless any condition is satisfied, such an effect is not exhibited.

The effect as above is particularly noticeable when such a chemical structure that a (meth)acryloyl group is bonded to an alkylene oxide structure to form a terminal portion of the polyfunctional (meth)acrylic monomer is obtained.

A cured product formed from a polyfunctional monomer small in equivalent weight of functional groups, which has formed the conventional surface layer, is high in hardness and excellent in scratch resistance and wear resistance, whereas unreacted (meth)acryloyl groups remain therein. Therefore, the unreacted residues trap charges, resistance tends to fluctuate, and resistance lowers due to chemical deterioration of the cured product attributed to ozone or nitrogen oxide representing a product resulting from discharging. The surface layer in the present embodiment properly solves this problem.

The surface layer in the present embodiment simultaneously solves the problem of lowering in cross-linking density or lowering in resistance due to wear and tear attributed to addition of a monofunctional monomer or a bifunctional monomer, which has been done for enhancing reactivity of the conventional surface layer. Such a surface layer will be described in further detail below.

Initially, the cured (meth)acrylic resin which forms the surface layer in the present embodiment refers to a (meth) acrylic resin cured through irradiation with active rays such as ultraviolet rays, however, it may be cured by means other than irradiation with active rays. Such a (meth)acrylic resin generally means a polymer of acrylic acid ester or methacrylic acid ester. In the present embodiment, however, limitation thereto is not intended, and a structure in which an acryloyl group or a methacryloyl group is polymerized is widely encompassed.

In the present embodiment, "(meth)acrylic" means "acrylic or methacrylic." Therefore, the "(meth)acrylic resin" means an "acrylic resin or methacrylic resin," and the "(meth) acrylic monomer" means an "acrylic monomer or methacrylic monomer." Similarly, "(meth)acryloyl" means "acryloyl or methacryloyl," and therefore the "(meth)acryloyl group" means an "acryloyl group or methacryloyl group."

The "cured (meth)acrylic resin containing a constitutional unit derived from a polyfunctional (meth)acrylic monomer" means that a cured (meth)acrylic resin is formed by polymerizing a polyfunctional (meth)acrylic monomer representing a monomer and that a chemical structure after polymerization of the polyfunctional (meth)acrylic monomer is contained in the cured (meth)acrylic resin as a constitutional unit.

Such a cured (meth)acrylic resin is not limited to a resin obtained by polymerizing only a polyfunctional (meth) acrylic monomer and it may be obtained by copolymerizing a polyfunctional (meth)acrylic monomer and another monomer. Therefore, the cured (meth)acrylic resin in the present embodiment includes a constitutional unit derived from a polyfunctional (meth)acrylic monomer and a constitutional unit derived from another monomer.

The polyfunctional (meth)acrylic monomer in the present embodiment is required to contain n alkylene oxide structures and m (meth)acryloyl groups, with relation of n/m≤5 and m≥3 being satisfied (n and m being a positive integer), and the alkylene oxide structure is required to contain an alkylene group having a carbon number not smaller than 2. More preferably, n and m suitably satisfy relation of n/m≤3 and m≥3 (n and m being a positive integer) and the alkylene oxide structure suitably contains an alkylene group having a carbon number from 2 to 5.

Here, when m is smaller than 3, a dense three-dimensional cross-linked structure cannot be formed and a hardness is lowered, which is not preferred. Though the upper limit of m is not particularly limited, from a point of view of improvement in reactivity of a (meth)acryloyl group, the upper limit is preferably not greater than 10 and further preferably not greater than 6. When n/m exceeds 5, denseness is insufficient and sufficient hardness is not obtained, although a cross-linked structure is formed. Though the lower limit of n/m is not particularly limited, from a point of view of uniform introduction of an alkylene group, the lower limit is preferably not smaller than 1.

The alkylene oxide structure in the present embodiment means a structure in which an alkylene group and a divalent oxygen atom are bonded to each other, and means, for example, a structure (a group) expressed with "-A—O—" where "-A-" represents an alkylene group and "—O—" represents a divalent oxygen atom. N alkylene oxide structures means the number of such alkylene oxide structures being n. When a plurality of alkylene oxide structures are continuous in series, the number of individual alkylene structures included in the continuous structure is counted as it is. For example, when three "-A—O—"s exemplified above are continuous in series, the number of alkylene structures is counted as three. N alkylene structures may be the same or different from one another in structure.

When an alkylene group has a carbon number of 1 in such an alkylene structure, the effect as above cannot be exhibited. Though the upper limit of the carbon number is not particularly limited, from a point of view of suppression of crystallinity of a molecule, the upper limit is preferably not greater than 5.

Such an alkylene group may be in a straight chain or branched. Suitable examples include an ethylene group, a propylene group, an isopropylene group, a butytene group, an isobutylene group, a pentylene group, and a 1,2-propylene group.

Specific examples of the polyfunctional (meth)acrylic monomer can include compounds expressed with Formula (1) to Formula (19) below.

Formula (1)

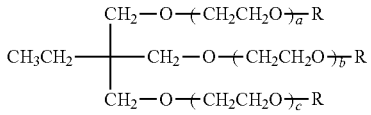

Formula (2)

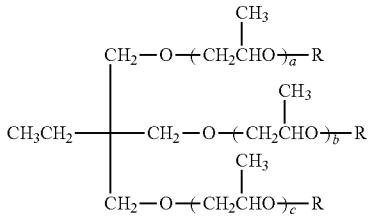

Formula (3)

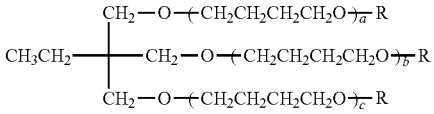

Formula (4)

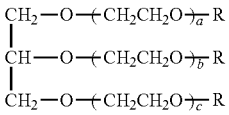

Formula (5)

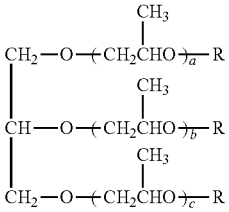

In the compounds expressed with Formula (1) to Formula (5) above, R represents an acryloyl group or a methacryloyl group, and a, b, and c each represent 0 or a positive integer and satisfy relation of a+b+c≤15. R in the same molecule represents the same group. The sum of a, b, and c represents the number of alkylene structures, and the number of Rs (that is, 3) represents the number of (meth)acryloyl groups.

Formula (6)

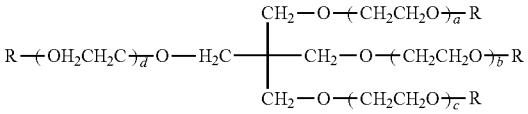

-continued

Formula (7)

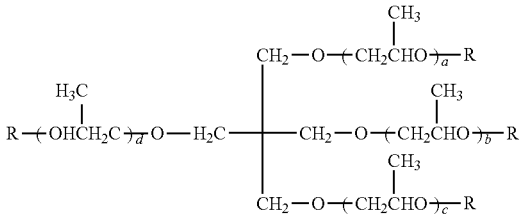

Formula (8)

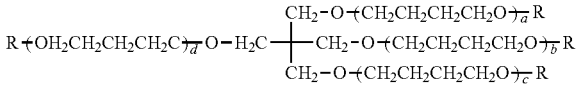

Formula (9)

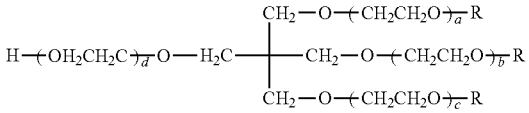

Formula (10)

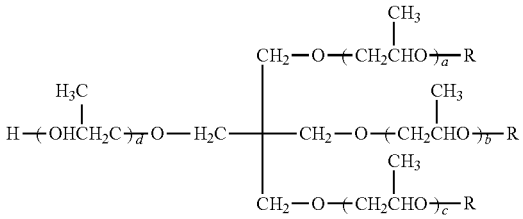

Formula (11)

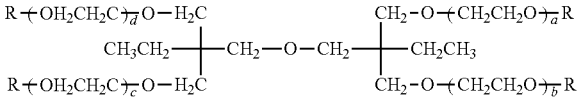

Formula (12)

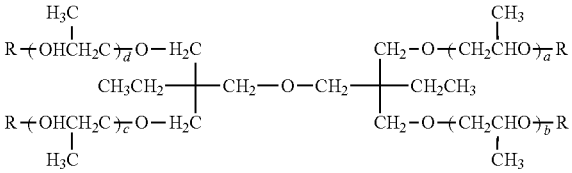

In the compounds expressed with Formula (6) to Formula (12) above, R represents an acryloyl group or a methacryloyl group, and a, b, c, and d each represent 0 or a positive integer and satisfy relation of a+b+c+d≤20. R in the same molecule represents the same group. The sum of a, b, c, and d represents the number of alkylene structures, and the number of Rs represents the number of (meth)acryloyl groups.

Formula (13)

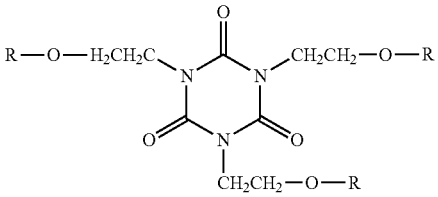

-continued

Formula (14)

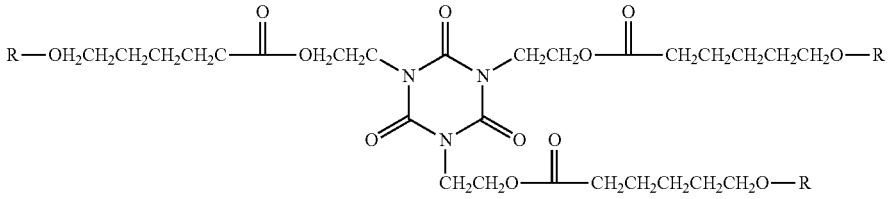

In the compounds expressed with Formula (13) and Formula (14) above, R represents an acryloyl group or a methacryloyl group. R in the same molecule represents the same group.

Formula (15)

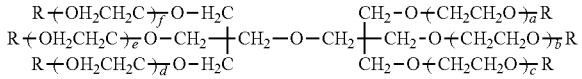

Formula (16)

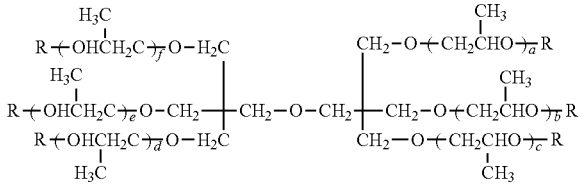

Formula (17)

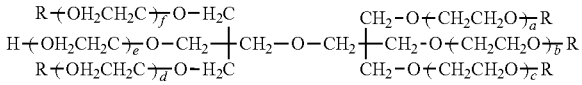

Formula (18)

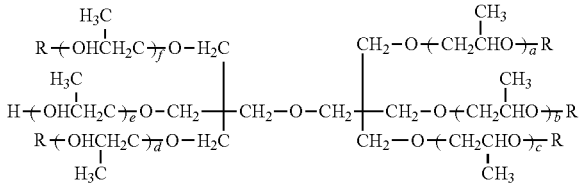

In the compounds expressed with Formula (15) to Formula (18) above, R represents an acryloyl group or a methacryloyl group, and a, b, c, d, e, and f each represent 0 or a positive integer and satisfy relation of a+b+c+d+e+f≤30. R in the same molecule represents the same group. The sum of a, b, c, d, e, and f represents the number of alkylene structures, and the number of Rs represents the number of (meth)acryloyl groups.

In the compound expressed with Formula (19) above, R represents an acryloyl group or a methacryloyl group, and a and b each represent an integer not smaller than 1 and satisfy relation of a+b=6. R in the same molecule represents the same group. Formula (19) shows that two groups in the right formula randomly substitute at 6 substitution positions in the left formula.

When the cured (meth)acrylic resin in the present embodiment contains a constitutional unit derived from another monomer, another monomer can be exemplified by a "polyfunctional (meth)acrylic monomer other than the polyfunctional (meth)acrylic monomer" and "other various monomers." More specifically, the "polyfunctional (meth)acrylic monomer other than the polyfunctional (meth)acrylic monomer" includes a bifunctional monomer such as bis(2-acryloxyethyl)-hydroxyethyl-isocyanurate, 1,6-hexanediol diacrylate, 1,4-butanediol diacrylate, 1,9-nonanediol diacrylate, neopentyl glycol diacrylate, neopentylglycol diacrylate hydroxypivalate, and urethane acrylate, and a polyfunctional monomer having three or more functional groups such as trimethylol propane triacrylate (TMPTA), pentaerythritol triacrylate, tris(acryloxyethyl)isocyanurate, di(trimethylolpropane) tetraacrylate, pentaerythritol tetraacrylate (PETTA), dipentacrythritol hexa acrylate (DPHA), urethane acrylate, and an ester compound synthesized from polyalcohol and polybasic acid and (meth)acrylic acid (for example, an ester compound synthesized from trimethylolethane/succinic acid/acrylic acid=2/1/4 moles), which have two or more (meth)acryloyl groups in one molecule.

Examples of "other various monomers" include (I) a (meth)acrylic acid derivative, (II) an aromatic vinyl monomer, (III) an olefin-based hydrocarbon monomer, (IV) a vinyl ester monomer, (V) a vinyl halide monomer, and (VI) a vinyl ether monomer.

Specific examples of (I) the (meth)acrylic acid derivative include alkyl (meth)acrylates such as (meth)acrylonitrile, methyl (meth)acrylate, butyl (meth)acrylate, ethylhexyl (meth)acrylate, and stearyl (meth)acrylate, and benzyl (meth) acrylate.

Specific examples of (II) the aromatic vinyl monomer include styrenes such as styrene, methylstyrene, ethylstyrene, chlorostyrene, monofluoro methylstyrene, difluoromethylstyrene, and trifluoromethylstyrene.

Formula (19)

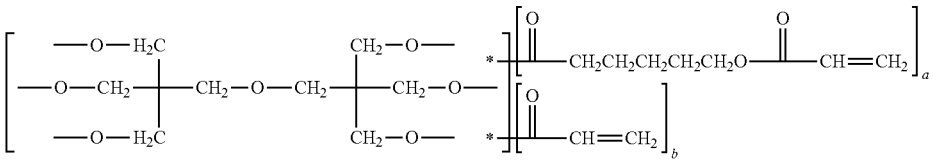

Specific examples of (III) the olefin-based hydrocarbon monomer include ethylene, propylene, butadiene, isobutylene, isoprene, and 1,4-pentadiene.

A specific example of (IV) the vinyl ester monomer includes vinyl acetate.

Specific examples of (V) the vinyl halide monomer include vinyl chloride and vinylidene chloride.

A specific example of (VI) the vinyl ether monomer includes vinyl methyl ether.

One type of these other monomers can be used, or two or more types of them can be used as being mixed, however, a ratio of mixing to the polyfunctional (meth)acrylic monomer in the present embodiment is preferably not higher than 90 mass %. When the ratio exceeds 90 mass %, the excellent effect as above may not be exhibited. Here, the ratio of mixing refers to a result calculated as a constitutional unit which forms a cured (meth)acrylic resin.

The surface layer in the present embodiment has a thickness preferably from 1 to 10 μm and more preferably from 1 to 5 μm, in consideration of mechanical strength, image quality, and manufacturing cost.

Such a surface layer can be formed, for example, by applying a surface layer forming application solution onto an outer circumferential surface of the resin base material layer in a shape of an endless belt. Specifically, a surface layer forming application solution formulated as below is applied onto the outer circumferential surface with the use of an applicator with an immersion application method. Conditions as below are adopted as application conditions, and after a coating film is formed to a dry film thickness of 1 to 5 μm, the coating film is irradiated with active rays such as ultraviolet rays under irradiation conditions below. As the coating film is thus cured, the surface layer is formed. Irradiation with active rays such as ultraviolet rays can be carried out while a light source is fixed and the resin base material layer in a shape of an endless belt having the coating film formed on the outer circumferential surface is rotated.

(Formulation of Surface Layer Forming Application Solution)

The application solution can be prepared by dissolving and dispersing 10 to 100 parts by volume of a polyfunctional (meth)acrylic monomer, 0 to 90 parts by volume of other monomers, 0 to 40 parts by volume of metal oxide fine particles subjected to surface treatment, 0 to 10 parts by volume of various additives, and 1 to 10 parts by volume of a photopolymerization initiator in a solvent (such as methyl isobutyl ketone (MIBK), propylene glycol monomethyl ether acetate (PMA), ethanol, isopropyl alcohol, or sec-butanol) such that a concentration of solids is 10 mass %.

(Application Condition)

Amount of supply of application solution: 1 L/min.

(Irradiation Condition)

Type of light source: high-pressure mercury lamp or LED light source

Distance from irradiation port to surface of coating film: 1 to 100 mm

Amount of emitted light: 400 to 2000 mJ/cm$^2$

Time period for irradiation (time period for rotation of base material): 20 to 1000 seconds <Metal Oxide Fine Particles Subjected to Surface Treatment>

The surface layer of the intermediate transfer element in the present embodiment can contain metal oxide fine particles subjected to surface treatment. As the surface layer contains the metal oxide fine particles, toughness is provided to the surface layer and high durability is obtained. The metal oxide fine particles subjected to surface treatment can be obtained by subjecting untreated metal oxide fine particles to surface treatment with a surface treatment agent.

The untreated metal oxide fine particles should only be composed of an oxide of a metal including also a transition metal, and examples thereof include silica (silicon oxide), magnesium oxide, zinc oxide, lead oxide, aluminum oxide (alumina), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide. Among these, titanium oxide, aluminum oxide (alumina), zinc oxide, and tin oxide are preferred, and in particular, aluminum oxide (alumina) and tin oxide are preferred.

These untreated metal oxide fine particles are fabricated with a general manufacturing method such as a gas phase method, a chlorine method, a sulfuric acid method, a plasma method, or an electrolysis method.

The untreated metal oxide fine particles have a number average primary particle size preferably in a range not smaller than 1 nm and not greater than 300 nm and particularly preferably from 3 to 100 nm. When the particle size is excessively small, wear resistance is not sufficient. When the particle size is excessively large, dispersibility of particles is poor and the particles tend to precipitate in an application solution, and the particles interfere photocuring of the surface layer and hence wear resistance may become insufficient.

The number average primary particle size of the untreated metal oxide fine particles is defined as a value obtained by calculating a number average primary particle size by taking a magnified photograph at 1000× with a scanning electron microscope (manufactured by JEOL Ltd.), which has randomly taken in 300 particles with a scanner, and subjecting the photograph image (with aggregated particles being excluded) to an automatic image processing analyzer (trade name: "LUZEX AP" manufactured by Nireco Corporation) software version Ver. 1.32.

Examples of a surface treatment agent used for surface treatment of the untreated metal oxide fine particles include a compound having a radical polymerizable functional group. Examples of this radical polymerizable functional group include an acryloyl group or a methacryloyl group. Therefore, a compound having a (meth)acryloyl group represents a suitable surface treatment agent, and hence the metal oxide fine particles in the present embodiment are preferably subjected to surface treatment with a compound having a (meth)acryloyl group (that is, an acryloyl group or a methacryloyl group).

In order to provide low surface energy characteristics, a silicone oil or a compound having a polyfluoroalkyl group can also be employed as a surface treatment agent. A straight silicone oil (for example, methyl hydrogen polysiloxane (MHPS)) or modified silicone oil (for example, a single-end carbinol modified silicone oil or a single-end diol modified silicone oil) can be employed as the silicone oil.

At least any of a radical polymerizable functional group and a low surface energy functional group is preferably introduced into a surface of the metal oxide fine particles subjected to surface treatment in the present embodiment by treating the surface with a surface treatment agent as above. Here, the low surface energy functional group refers to a functional group introduced by a surface treatment agent used for providing low surface energy characteristics, and it is exemplified by a silane-coupled silicone oil group or polyfluoroalkyl group. When both of them are introduced, a ratio between the radical polymerizable functional group and the low surface energy functional group is preferably from 2:1 to 1:2.

A compound having in the same molecule, a functional group having carbon-carbon double bond and a polar group such as an alkoyx group coupled to a hydroxyl group on the surface of untreated metal oxide fine particles is preferred as the surface treatment agent having the radical polymerizable functional group used for surface treatment of the untreated metal oxide fine particles.

A compound having a functional group which will be a resin such as polystyrene or polyacrylate as a result of polymerization (curing) through irradiation with light such as ultraviolet rays is suitable as the surface treatment agent having the radical polymerizable functional group, and among others, a silane compound having a reactive acryloyl group or methacryloyl group is particularly preferred because curing with a small amount of light or in a short period of time can be achieved.

For example, a compound expressed with a general formula (I) below represents a surface treatment agent having a radical polymerizable functional group.

General Formula (I)

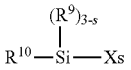

(In General Formula (I), $R^9$ represents a hydrogen atom, an alkyl group having a carbon number from 1 to 10, or an aralkyl group having a carbon number from 1 to 10, $R^{10}$ represents an organic group having reactive double bond, X represents a halogen atom, an alkoxy group, an acyloxy group, an aminoxy group, or a phenoxy group, and s represents an integer from 1 to 3.)

S-1 to S-30 represent examples of compounds expressed with General Formula (I) above.

S-1 $CH_2{=}CHSi(CH_3)(OCH_3)_2$
S-2 $CH_2{=}CHSi(OCH_3)_3$
S-3 $CH_2{=}CHSiCl_3$
S-4 $CH_2{=}CHCOO(CH_2)_2Si(CH_3)(OCH_3)_2$
S-5 $CH_2{=}CHCOO(CH_2)_2Si(OCH_3)_3$
S-6 $CH_2{=}CHCOO(CH_2)_2Si(OC_2H_5)(OCH_3)_2$
S-7 $CH_2{=}CHCOO(CH_2)_3Si(OCH_3)_3$
S-8 $CH_2{=}CHCOO(CH_2)_2Si(CH_3)Cl_2$
S-9 $CH_2{=}CHCOO(CH_2)_2SiCl_3$
S-10 $CH_2{=}CHCOO(CH_2)_3Si(CH_3)Cl_2$
S-11 $CH_2{=}CHCOO(CH_2)_3SiCl_3$
S-12 $CH_2{=}C(CH_3)COO(CH_2)_2Si(CH_3)(OCH_3)_2$
S-13 $CH_2{=}C(CH_3)COO(CH_2)_2Si(OCH_3)_3$
S-14 $CH_2{=}C(CH_3)COO(CH_2)_3Si(CH_3)(OCH_3)_2$
S-15 $CH_2{=}C(CH_3)COO(CH_2)_3Si(OCH_3)_3$
S-16 $CH_2{=}C(CH_3)COO(CH_2)_2Si(CH_3)Cl_2$
S-17 $CH_2{=}C(CH_3)COO(CH_2)_2SiCl_3$
S-18 $CH_2{=}C(CH_3)COO(CH_2)_3Si(CH_3)Cl_2$
S-19 $CH_2{=}C(CH_3)COO(CH_2)_3SiCl_3$
S-20 $CH_2{=}CHSi(C_2H_5)(OCH_3)_2$
S-21 $CH_2{=}C(CH_3)Si(OCH_3)_3$
S-22 $CH_2{=}C(CH_3)Si(OC_2H_5)_3$
S-23 $CH_2{=}CHSi(OCH_3)_3$
S-24 $CH_2{=}C(CH_3)Si(CH_3(OCH_3)_2$
S-25 $CH_2{=}CHSi(CH_3)Cl_2$
S-26 $CH_2{=}CHCOOSi(OCH_3)_3$
S-27 $CH_2{=}CHCOOSi(OC_2H_5)_3$
S-28 $CH_2{=}C(CH_3)COOSi(OCH_3)_3$
S-29 $CH_2{=}C(CH_3)COOSi(OC_2H_5)_3$
S-30 $CH_2{=}C(CH_3)COO(CH_2)_3Si(OC_2H_5)_3$

Other than the compounds expressed with General Formula (I) above, S-31 to S-33 below may be used as a compound having a radical polymerizable functional group.

S-31

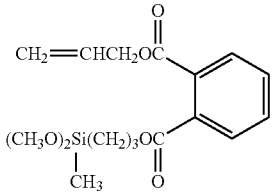

S-32

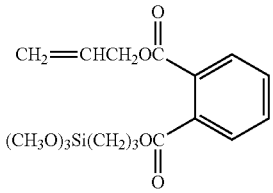

S-33

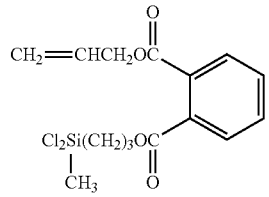

One of the compounds alone can be used or two or more types of them may be used as being mixed.

An epoxy-based compound shown as S-35 to S37 below can also be used as the surface treatment agent.

S-35

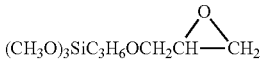

S-36

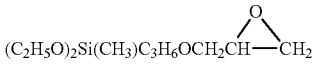

S-37

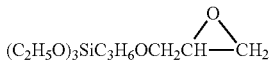

A compound having a (meth)acryloyl group in the surface treatment agent exemplified above is a compound having a (meth)acryloyl group in the present embodiment.

A method of surface treatment is exemplified by a method of using a wet medium dispersion type apparatus using 0.1 to 200 parts by volume of a surface treatment agent and 50 to 5000 parts by volume of a solvent with respect to 100 parts by volume of untreated metal oxide fine particles By wet dispersing slurry (a suspension of solid particles) containing untreated metal oxide fine particles and a surface treatment agent, an aggregate of the untreated metal oxide fine particles is crushed and simultaneously surface treatment of the untreated metal oxide fine particles proceeds. Thereafter, the solvent is removed and powderization is carried out. Therefore, uniform and finer metal oxide fine particles subjected to surface treatment with the surface treatment agent can also be obtained.

An amount of surface treatment by the surface treatment agent (an amount of coverage with the surface treatment agent) is preferably not lower than 0.1 mass % and not higher than 60 mass % with respect to the metal oxide fine particles. The amount is particularly preferably not lower than 5 mass % and not higher than 40 mass %.

Since this surface treatment agent contains Si, an amount of surface treatment can be found by heat treatment for 3 hours at 550° C., of the metal oxide fine particles subjected to surface treatment, quantitative analysis of ignition residue with fluorescent X-rays, and calculation by conversion into a molecular weight based on an amount of Si.

The wet medium dispersion type apparatus refers to an apparatus which can perform crushing and dispersing steps by filling a vessel with beads as media and rotating an agitation disk attached perpendicularly to a rotation shaft at a high speed to crush aggregated particles of the metal oxide fine particles. A construction does not give rise to a particular problem so long as the apparatus can sufficiently disperse untreated metal oxide fine particles during surface treatment of the untreated metal oxide fine particles and can achieve surface treatment. For example, various types such as a vertical or horizontal type and a continuous or batch-wise type can be adopted. Specifically, a sand mill, an Ultra Visco mill, a pearl mill, a grain mill, a dyno mill, an agitator mill, or a dynamic mill can be employed. Such a dispersion type apparatus carries out fine crushing and dispersion by using a crushing medium such as balls and beads owing to impact collapse, friction, shear, or shear stress. Balls made of a source material such as glass, alumina, zircon, zirconia, steel, or flint can be used as beads used in the dispersion type apparatus, and particularly, balls made of zirconia or zircon are preferred. Though a bead having a diameter approximately from 1 mm to 2 mm is normally employed as the bead, a bead having a size approximately from 0.3 mm to 1.0 mm is preferably employed in the present embodiment.

Various materials such as stainless steel nylon, and ceramics can be used for a disk or an inner wall of a vessel in a wet medium dispersion type apparatus, and in particular, a material made of ceramics such as zirconia or silicon carbide is preferably adopted in the present embodiment.

Through wet treatment as above, metal oxide fine particles subjected to surface treatment with a surface treatment agent (that is, metal oxide fine particles subjected to surface treatment) can be obtained.

Preferably, 5 to 40 parts by volume of the metal oxide fine particles subjected to surface treatment as above are contained with respect to 100 parts by volume of a cured (meth) acrylic resin.

Here, a part by volume in the intermediate transfer element in the present embodiment can be calculated by conversion, with specific gravity of each component forming the surface layer being defined as follows: an organic substance (a (meth) acrylic monomer) of 1.1, and alumina of 3.5, tin oxide of 6.3, titania of 3.7, and silica of 2.2, which represent the metal oxide fine particles.

<Additive>

Each of the resin base material layer, the surface layer, and other layers such as the elastic body layer can contain an additive. Examples of such an additive include a photocuring initiator, conductive particles (a conductive filler), various fillers (which mainly aim at improvement in strength), various modifiers (a graft copolymer), an organic solvent, a light stabilizer, an ultraviolet absorbing agent, a catalyst, a coloring agent, an antistatic agent, a lubricant, a leveling agent, an antifoam agent, a polymerization accelerator, an antioxidant, a flame retardant, an infrared absorbing agent, a surfactant, and a surface modifier.

<Image Formation Apparatus>

An image formation apparatus in the present embodiment includes the intermediate transfer element described above, and so long as such an intermediate transfer element is included, other components can be adopted without a conventionally known component being particularly restricted.

An image formation apparatus in the present embodiment will be described below with reference to FIG. 1. FIG. 1 is a schematic diagram showing one example of the image formation apparatus in the present embodiment.

An image formation apparatus 1 in FIG. 1 forms an image on a recording material with known electrophotography, includes an image processing portion 10, a transfer portion 20, a paper feed portion 30, a fixation portion 40, and a control unit 45, and selectively carries out color and monochrome printing based on a print job accepted from an external terminal device (not shown) through a network (for example, LAN).

Image processing portion 10 has imaging portions 10Y to 10K corresponding to development colors of yellow (Y), magenta (M), cyan (C), and black (K), respectively. Imaging portion 10Y includes a photoconductor drum 11 representing an electrostatic latent image carrier, as well as a charger 12, an exposure portion 13, a development portion 14, a primary transfer roller 15, and a cleaner 16 which are arranged around photoconductor drum 11. Charger 12 charges a circumferential surface of photoconductor drum 11 rotating in a direction shown with an arrow A.

Exposure portion 13 forms an electrostatic latent image on photoconductor drum 11 by exposing and scanning charged photoconductor drum 11 with laser beams. Development portion 14 accommodates a developer containing toner therein and develops the electrostatic latent image on photoconductor drum 11 with toner, so that a toner image in Y color is formed on photoconductor drum 11. Namely, the toner image is thus carried on the electrostatic latent image carrier.

Primary transfer roller 15 transfers the toner image in Y color on photoconductor drum 11 onto an intermediate transfer element 21 owing to an electrostatic action. Namely, the toner image is primarily transferred to the intermediate transfer element. Cleaner 16 cleans remaining toner which remained on photoconductor drum 11 after transferring. Other imaging portions 10M to 10K are also constructed similarly to imaging portion 10Y, and reference numerals are not provided in the FIGURE. Transfer portion 20 includes intermediate transfer element 21 which is placed over a drive roller 24 and a driven roller 25 and runs in a direction shown with an arrow as circulating. Intermediate transfer element 21 is in a shape of a seamless belt (that is, a shape of an endless belt), and is in a cylindrical shape obtained by injection molding or centrifugal molding of a resin material so as to achieve a desired circumferential length determined in design.

In executing color printing (color mode), an image is formed with toner in a corresponding color on photoconductor drum 11 for each of imaging portions 10M to 10K, and each of the formed toner images is transferred onto intermediate transfer element 21. An operation for imaging in each color of Y to K is performed at different liming from an upstream side toward a downstream side such that toner image in each color is transferred as being superimposed on the same position on running intermediate transfer element 21.

Paper feed portion 30 feeds a sheet S representing a recording material one by one from a paper feed cassette at the timing of imaging, and transports fed sheet S over a transportation path 31 toward a secondary transfer roller 22. When sheet S transported to secondary transfer roller 22 passes between secondary transfer roller 22 and intermediate transfer element 21, the toner images in respective colors formed on intermediate transfer element 21 are secondarily transferred collectively onto sheet S owing to an electrostatic action of secondary transfer roller 22. Namely, the toner image is secondarily transferred from the intermediate transfer element to the recording material.

Sheet S after secondary transfer of the toner images of respective colors is transported to fixation portion 40, and heated and pressurized in fixation portion 40. Then, toner on the surface thereof is fused and fixed to the surface of sheet S. Thereafter, the sheet is ejected onto a paper ejection tray 33 by a paper ejection roller 32. An image corresponding to the toner image is thus formed on the recording material.

Though an operation in executing the color mode has been described above, in executing monochrome printing such as printing in a black color (a monochrome mode), only imaging portion 10K for black color is driven and each step of charging, exposure, development, transfer, and fixation for the black color is performed through the operation as above, so that an image in the black color is formed (printed) on recording sheet S.

Toner or a toner pattern which has not completely been transferred to recording sheet S on intermediate transfer element 21 is removed by a cleaning blade 26 arranged at a position facing driven roller 25 with intermediate transfer element 21 being interposed. On a downstream side of imaging unit 10K in a direction of running of intermediate transfer element 21, for example, a density detection sensor 23 implemented by a reflective photoelectric sensor is arranged to detect a density of a toner pattern formed on intermediate transfer element 21.

Control unit 45 controls each portion based on data of a print job accepted from an external terminal device through the network for a smooth printing operation. An operation panel 35 is arranged at a position on a front and upper side of a main body of image formation apparatus 1, which is readily reached by a user for operation. Operation panel 35 includes a button or a liquid crystal display portion of a touch panel type for accepting various instructions from a user, and can transmit contents of the accepted instruction to control unit 45.

Examples of such an image formation apparatus include an image formation apparatus of an electrophotography type such as a copier, a printer, a digital printer, or a simple printer, and the image formation apparatus may be any of a dry type and a wet type. A dry type image formation apparatus is particularly effective.

Such an image formation apparatus exhibits an excellent effect of ability to form an image high in image quality for a long period of time.

EXAMPLES

Though the present invention will be described hereinafter in further detail with reference to Examples, the present invention is not limited thereto.

Example 1

(1) Fabrication of Resin Base Material Layer

A resin base material layer for an intermediate transfer element was fabricated in accordance with a method below.

Namely, in a uniaxial extruder, 100 parts by volume of a polyphenylene sulfide resin (trade name: "E2180" manufactured by Toray Industries, Inc.), 16 parts by volume of a conductive filler (trade name: "Furnace #3030B" manufactured by Mitsubishi Chemical Corporation), 1 part by volume of a graft copolymer (trade name: "Modiper A4400" manufactured by NOF Corporation), and 0.2 part by volume of a lubricant (calcium montanate) were introduced, molten, and mixed and kneaded. A resin mixture was thus obtained.

Then, an annular die having an outlet like a slit and in a shape of a seamless belt was attached to a tip end of the uniaxial extruder, and the mixed and kneaded resin mixture was extruded into a shape of the seamless belt. Then, the extruded resin mixture in the shape of the seamless belt was placed on the outside of a cooling cylinder provided at a discharge end, and cooled to solidify. Thus, a resin base material layer for intermediate transfer element in a shape of a seamless cylinder (endless belt) having a thickness of 120 μm was fabricated.

(2) Preparation of Metal Oxide Fine Particles Subjected to Surface Treatment In 100 parts by volume of tin oxide fine particles having an average particle size of 34 mn representing untreated metal oxide fine particles, 15 parts by volume of 3-acryloxypropyltrimethoxysilane (trade name: "KBM-5103" manufactured by Shin-Etsu Chemical Co., Ltd.) representing a surface treatment agent and 400 parts by volume of a solvent (a mixed solvent of toluene:isopropyl alcohol=1:1 (volume ratio)) were mixed and dispersed with the use of a wet medium dispersion type apparatus. Thereafter, the solvent was removed, followed by drying for 30 minutes at 150° C. Thus, tin oxide fine particles (P-1) subjected to surface treatment were obtained as metal oxide fine particles subjected to surface treatment.

(3) Preparation of Surface Layer Forming Application Solution

A surface layer forming application solution S was prepared by dissolving and dispersing 75 parts by volume of a compound expressed with Formula (6) (a=b=c=d=1, R representing an acryloyl group, and 4 Rs being provided) as a polyfunctional (meth)acrylic monomer, 25 parts by volume of the metal oxide fine particles (P-1) subjected to surface treatment, and 4 parts by volume of a photopolymerization initiator (trade name: "IRGACURE TPO" manufactured by BASF SE) into methyl isobutyl ketone (MIBK) representing a solvent, such that a concentration of solids was 10 mass %.

(4) Formation of Surface Layer

A coating film was formed by applying surface layer forming application solution S onto the outer circumferential surface of the resin base material layer to a dry film thickness of 5 μm under application conditions below with an immersion application method with the use of an applicator.

In succession, this coating film was irradiated with ultraviolet rays as active rays (active energy beams) under irradiation conditions below, so that the coating film was cured and the surface layer was formed. An intermediate transfer element T was thus obtained. The ultraviolet rays were emitted while a light source was fixed and a precursor having the coating film formed on the outer circumferential surface of the resin base material layer was rotated at a peripheral speed of 60 mm/s.

(Application Condition)

Amount of supply of application solution: 1 L/min.

(Condition of Irradiation Ultraviolet Rays)

Type of light source: 365 nm LED light source (trade name: "SPX-TA" manufactured by Eye Graphics Co., Ltd.)

Distance from irradiation port to surface of coating film: 100 mm

Atmosphere: nitrogen

Amount of emitted light: 1 J/cm$^2$

Time period for irradiation (time period for rotation of precursor): 240 seconds Examples 2 to 17 and Comparative Examples 1 to 6

Intermediate transfer elements in Examples 2 to 17 and Comparative Examples 1 to 6 were fabricated similarly to intermediate transfer element T in Example 1.

(1) Fabrication of Resin Base Material Layer

A resin base material layer was fabricated as in Example 1, except for use of a resin shown in a field of "resin base material layer" in Table 1 instead of the polyphenylene sulfide resin used for fabrication of the resin base material layer in Example 1.

Abbreviation in the field of "resin base material layer" in Table 1 means as follows.

PPS: polyphenylene sulfide resin (the same as the resin in Example 1)

PAI: polyamide imide resin (trade name: "VYLOMAX HR16NN" manufactured by Toyobo Co., Ltd.)

PEEK: polyether ether ketone resin (trade name: "VICTREX PEEK 381G" manufactured by Victrex PLC)

PI: polyimide resin (trade name: "U-Varnish-A" manufactured by Ube Industries, Ltd.)

(2) Preparation of Metal Oxide Fine Particles Subjected to Surface Treatment

Metal oxide fine particles subjected to surface treatment shown in a field of "metal oxide fine particles" in Table 1 were used instead of the metal oxide fine particles subjected to surface treatment which was prepared in Example 1.

Specifically, a field of "type" in a field of "metal oxide fine particles" in Table 1 shows a type of untreated metal oxide fine particles used, a reference in a field of "surface treatment" means as follows, and a field of "amount of addition" shows a part by volume of added metal oxide fine particles subjected to surface treatment.

A: representing surface treatment the same as in Example 1

B: representing use of methyl hydrogen polysiloxane (trade name: "KF-9901" manufactured by Shin-Etsu Chemical Co., Ltd.) instead of 3-acryloxypropyltrimethoxysilane representing the surface treatment agent in treatment in Example 1

PTO in the field of "type" represents tin oxide doped with phosphorus.

(3) Preparation of Surface Layer Forming Application Solution

A surface layer forming application solution was prepared as in Example 1, except for use of a monomer shown in the field of "polyfunctional (meth)acrylic monomer A" in Table 1 by an amount of addition (parts by volume) shown in Table 1 as the polyfunctional (meth)acrylic monomer instead of the polyfunctional (meth)acrylic monomer used in Example 1.

Abbreviation in the field of "polyfunctional (meth)acrylic monomer A" in Table 1 means as follows.

Formula No.: representing the number of a corresponding formula among Formulae (1) to (19)

R: representing R in the formula above, with "A" representing an acryloyl group and "M" representing a methacryloyl group m: representing the number of (meth)acryloyl groups (R) present in the formula n: representing the number of alkylene oxide structures present in the formula, for example, the sum of a, b, c, and d in Formula (6)

n/m: representing a ratio n/m between m and n

Namely, for example, polyfunctional (meth)acrylic monomer A in Example 2 represents the polyfunctional (meth) acrylic monomer the same as in Example 1 except that R represents a methacryloyl group, and polyfunctional (meth) acrylic monomer A in Example 5 represents the compound in Formula (7), in which the sum (n) of a, b, c, and d is 4, the number (m) of (meth)acryloyl groups R (that is, acryloyl groups) is 4, and an amount of addition is 50 parts by volume.

Polyfunctional (meth)acrylic monomer A in each of Comparative Examples 3 and 4 represents a monomer in which an acryloyl group is bonded to both terminals of polyethylene glycol (of which number of repeating units is set to n in Table 1), rather than the polyfunctional (meth)acrylic monomer according to the present invention.

Polyfunctional (meth)acrylic monomer A in each of Comparative Examples 5 and 6 represents dipentaerythritol hexa acrylate rather than the polyfunctional (meth)acrylic monomer according to the present invention.

In Table 1, "polyfunctional (meth)acrylic monomer B" represents a polyfunctional (meth)acrylic monomer which is not a polyfunctional (meth)acrylic monomer according to the present invention (in this connection, "polyfunctional (meth) acrylic monomer A" in Table 1 representing the polyfunctional (meth)acrylic monomer according to the present invention), and an "acrylic monomer" represents an acrylic monomer which is not the polyfunctional (meth)acrylic monomer according to the present invention. In Table 1, Example 5, Example 10, Example 11, Comparative Example 5, and Comparative Example 6 show that the surface layer was formed of two types of monomer (that is, a cured (meth) acrylic resin forming the surface layer included two types of constitutional unit derived from respective monomers).

Abbreviations in fields of "polyfunctional (meth)acrylic monomer B" and "acrylic monomer" in Table 1 mean as follows.

TMPTA: trimethylol propane triacrylate

DPHA: dipentaerythritol hexa acrylate

PEGD: poly(ethylene glycol) diacrylate (see Formula (20) below)

An amount of addition is shown in part by volume.

Formula (20)

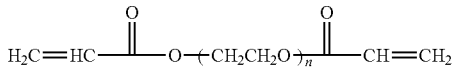

In addition to the components shown in Table 1, two parts by volume of ELEGAN 264 WAX (manufactured by NOF Corporation) representing quaternary ammonium salt were blended into the surface layer in Comparative Example 6.

(4) Formation of Surface Layer

An intermediate transfer element was obtained by forming a surface layer as in Example 1, except for use of a surface layer forming application solution prepared above, instead of surface layer forming application solution S used in Example 1.

TABLE 1

| Example/ Comperative Example | Resin Base Material Layer | Polyfunctional (Meth)acrylic Monomer A Formula No. | R | m | n | n/m | Amount of Addition | Polyfunctional (Meth)acrylic Monomer B Type | Amount of Addition | Acrylic Monomer Type | Amount of Addition | Metal Oxide Fine Particles Type | Surface Treatment | Amount of Addition |
|---|---|---|---|---|---|---|---|---|---|---|---|---|---|---|
| Example 1 | PPS | (6) | A | 4 | 4 | 1 | 75 | — | — | — | — | Tin Oxide | A | 25 |
| Example 2 | PPS | (6) | M | 4 | 4 | 1 | 75 | — | — | — | — | Tin Oxide | A | 25 |
| Example 3 | PPS | (6) | A | 4 | 16 | 4 | 75 | — | — | — | — | Tin Oxide | A | 25 |
| Example 4 | PAI | (6) | A | 4 | 4 | 1 | 75 | — | — | — | — | Tin Oxide | A | 25 |
| Example 5 | PPS | (7) | A | 4 | 4 | 1 | 50 | TMPTA | 25 | — | — | Tin Oxide | A | 25 |
| Example 6 | PPS | (15) | A | 6 | 6 | 1 | 75 | — | — | — | — | Tin Oxide | B | 25 |
| Example 7 | PPS | (15) | A | 6 | 30 | 1 | 75 | — | — | — | — | Tin Oxide | B | 25 |
| Example 8 | PPS | (2) | A | 3 | 3 | 8 | 75 | — | — | — | — | Alumina | A | 25 |
| Example 9 | PEEK | (6) | A | 4 | 4 | 1 | 75 | — | — | — | — | Tin Oxide | B | 25 |
| Example 10 | PPS | (2) | A | 3 | 9 | 1 | 50 | DPHA | 25 | — | — | Tin Oxide | A | 25 |
| Example 11 | PPS | (19) | A | 6 | 3 | 3 | 50 | DPHA | 25 | — | — | Tin Oxide | A | 25 |
| Example 12 | PI | (15) | A | 6 | 6 | 0.8 | 75 | — | — | — | — | Alumina | B | 25 |
| Example 13 | PPS | (6) | A | 4 | 4 | 1 | 90 | — | — | — | — | PTO | A | 10 |
| Example 14 | PPS | (6) | A | 4 | 4 | 1 | 75 | — | — | — | — | — | — | — |
| Example 15 | PPS | (6) | A | 4 | 4 | 1 | 75 | — | — | — | — | Tin Oxide | — | 25 |
| Example 16 | PPS | (6) | A | 4 | 4 | 1 | 75 | — | — | — | — | Alumina | — | 25 |
| Example 17 | PPS | (6) | M | 4 | 4 | 1 | 75 | — | — | — | — | Alumina | — | 25 |
| Comparative Example 1 | PPS | (6) | A | 4 | 35 | 8.75 | 75 | — | — | — | — | Tin Oxide | A | 25 |
| Comparative Example 2 | PPS | (6) | A | 4 | 24 | 5 | 75 | — | — | — | — | Tin Oxide | A | 25 |
| Comparative Example 3 | PPS | PEG | A | 2 | 2 | 1 | 75 | — | — | — | — | Tin Oxide | A | 25 |
| Comparitive Example 4 | PPS | PEG | A | 2 | 14 | 7 | 75 | — | — | — | — | Tin Oxide | A | 25 |
| Comparative Example 5 | PPS | DPHA | A | 6 | 0 | 0 | 50 | — | — | PEGD | 25 | Tin Oxide | A | 25 |
| Comparative Example 6 | PPS | DPHA | A | 6 | 0 | 0 | 50 | — | — | PEGD | 25 | — | — | — |

<Evaluation>

The intermediate transfer elements in Examples 1 to 17 and Comparative Examples 1 to 6 fabricated above were subjected to a printing durability test as below and evaluations 1 to 3 were made.

<Printing Durability Test>

The intermediate transfer element in each of Examples and Comparative Examples was set in a tandem color multi function peripheral (trade name, "bizhub PRO C6500" manufactured by Konica Minolta Business Technologies, Inc.), an amount of exposure was made appropriate, and an image of which rate of coverage with each color of yellow (Y), magenta (M), cyan (C), and black (Bk) was 2.5% was printed on one million sheets of acid-free paper representing a recording material at 20° C. and 50% RH.

The tandem color multi function peripheral adopts a laser exposure and reversal development system, is an image formation apparatus in which a toner image carried on an electrostatic latent image carrier is primarily transferred onto the intermediate transfer element and thereafter the toner image is secondarily transferred from the intermediate transfer element to a recording material, and is shown schematically in FIG. 1.

<Evaluation 1: Amount of Wear and Tear>

A thickness of the surface layer of each intermediate transfer element before and after the printing durability test was measured with a reflectance spectroscopic film thickness monitor (trade name: "FE-3000" manufactured by Otsuka Electronics Co., Ltd.), and an amount of wear and tear (an amount of decrease in film thickness) was calculated. Then, evaluation was made under criteria below. Table 2 shows result (in an item of "amount of wear and tear").

A: an amount of wear and tear after printing on one million sheets being less than 1 μm B: an amount of wear and tear after printing on one million sheets being not less than 1 μm and less than 2 μm C: an amount of wear and tear after printing on one million sheets being not less than 2 μm and less than 3 μm D: an amount of wear and tear after printing on one million sheets being not less than 3 μm <Evaluation 2: Fluctuation in Resistance>

A surface resistivity ρs (an applied voltage of 500 V) of each intermediate transfer element before and after the printing durability test was measured with a resistivity meter (trade name "Hiresta UX MCP-HT800 URS Probe" manufactured by Mitsubishi Chemical Analytech Co., Ltd.), and a rate of fluctuation in log ρs was calculated. Then, evaluation was made under criteria below. A lower rate of change indicates less fluctuation in resistance (change in resistance value). Table 2 shows results (in an item of "fluctuation in resistance").

A: rate of change in log ρs after printing on one million sheets being lower than 4%

B: rate of change in log ρs after printing on one million sheets being not lower than 4% and lower than 7%

C: rate of change in log ρs after printing on one million sheets being not lower than 7% and lower than 10%

D: rate of change in log ρs after printing on one million sheets being not lower than 10%

<Evaluation 3: Evaluation of Image>

A thin line having a line width of 6 dots was printed after the printing durability test, and a line width was measured.

Then, evaluation was made under criteria below. A smaller line width of 6-dot line width indicates higher image quality. Table 2 shows results (in an item of "evaluation of image").

A: line width of 6-dot line width being smaller than 350 μm

B: line width of 6-dot line width being not smaller than 350 μm and smaller than 400 μm C: line width of 6-dot line width being not smaller than 400 μm and smaller than 450 μm D: line width of 6-dot line width being not smaller than 450 μm

TABLE 2

| Example/ Comparative Example | Amount of Wear and Tear | Fluctuation in Resistance | Evaluation of Image |
|---|---|---|---|
| Example 1 | B | B | B |
| Example 2 | B | B | B |
| Example 3 | C | B | B |
| Example 4 | B | B | B |
| Example 5 | A | A | B |
| Example 6 | B | B | B |
| Example 7 | B | A | B |
| Example 8 | C | B | B |
| Example 9 | B | B | B |
| Example 10 | C | C | B |
| Example 11 | C | C | B |
| Example 12 | A | B | C |
| Example 13 | B | B | A |
| Example 14 | C | B | C |
| Example 15 | B | C | C |
| Example 16 | B | B | B |
| Example 17 | B | A | A |
| Comparative Example 1 | D | D | D |
| Comparative Example 2 | C | C | D |
| Comparative Example 3 | C | D | D |
| Comparative Example 4 | D | D | D |
| Comperative Example 5 | D | D | D |
| Comparative Example 6 | D | D | D |

As is clear from Table 2, it could be confirmed that the intermediate transfer elements in Examples were better in wear resistance and less in change in resistance value and could provide higher image quality than the intermediate transfer elements in Comparative Examples. Namely, it is clear that the intermediate transfer element according to the present invention, with the features according to the present invention, exhibits the excellent effect of high durability while having an excellent transfer function.

Though the embodiment and the examples of the present invention have been described above, combination of features in each embodiment and example described above as appropriate is also originally intended.

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. An intermediate transfer element included in an image formation apparatus, in which a toner image carried on an electrostatic latent image carrier is primarily transferred to the intermediate transfer element and thereafter the toner image is secondarily transferred from the intermediate transfer element to a recording material, the intermediate transfer element having a shape like an endless belt and including at least a resin base material layer and a surface layer, the surface layer being composed of a cured (meth)acrylic resin, the cured (meth)acrylic resin containing a constitutional unit derived from a polyfunctional (meth)acrylic monomer.

the polyfunctional (meth)acrylic monomer containing n alkylene oxide structures and m (meth)acryloyl groups, with relation of $n/m \leq 5$ and $m \geq 3$ being satisfied (n and m being a positive integer), and the alkylene oxide structure containing an alkylene group having a carbon number not smaller than 2.

2. The intermediate transfer element according to claim 1, wherein the polyfunctional (meth)acrylic monomer satisfies relation of $n/m \leq 3$ and $m \geq 3$ (n and m being a positive integer).

3. The intermediate transfer element according to claim 1, wherein the alkylene oxide structure contains an alkylene group having a carbon number from 2 to 5.

4. The intermediate transfer element according to claim 1, wherein the surface layer contains metal oxide fine particles subjected to surface treatment.

5. The intermediate transfer element according to claim 4, wherein the metal oxide fine particles are subjected to surface treatment with a compound having a (meth)acryloyl group.

6. An image formation apparatus comprising the intermediate transfer element according to claim 1.

* * * * *